US005517796A

United States Patent [19]

Koski et al.

[11] Patent Number: 5,517,796

[45] Date of Patent: May 21, 1996

[54] STAB-IN REMOVABLE END CONNECTOR

[75] Inventors: Gerald L. Koski, Parma; James J. Lehane, Columbia Station; Douglas B. Hooper, Lakewood; Paul D. LaLonde, Avon, all of Ohio

[73] Assignee: USG Interiors, Inc., Chicago, Ill.

[21] Appl. No.: 248,761

[22] Filed: May 25, 1994

[51] Int. Cl.[6] ..... E04B 2/00

[52] U.S. Cl. ..... 52/506.07; 52/664

[58] Field of Search ..... 52/506.07, 506.06, 52/664, 665, 668; 403/347

[56] References Cited

U.S. PATENT DOCUMENTS

| | | | |
|---|---|---|---|
| 1,996,047 | 3/1935 | Green | 293/54 |
| 2,013,384 | 9/1935 | Green | 189/82 |
| 2,890,583 | 6/1959 | Grosskortenhaus | 72/118 |
| 2,918,995 | 12/1959 | Kruger | 189/82 |
| 2,963,751 | 12/1960 | Mancini | 20/4 |
| 3,221,466 | 12/1965 | Downing, Jr. et al. | 52/726 |
| 3,283,467 | 11/1966 | Znamirowski | 52/663 |
| 3,359,697 | 12/1967 | Smith et al. | 52/506 |
| 3,378,980 | 4/1968 | Blitzer, Jr. | 52/668 |
| 3,501,185 | 3/1970 | Brown et al. | 287/189.36 |
| 3,550,341 | 12/1970 | Thompson | 52/488 |
| 3,693,303 | 9/1972 | Downing, Jr. et al. | 52/476 |
| 3,746,379 | 7/1973 | Sauer | 287/189.36 A |
| 3,807,116 | 4/1974 | Flynn | 52/615 |
| 3,922,829 | 12/1975 | Sauer | 52/667 |
| 4,034,534 | 7/1977 | Taylor | 52/668 |
| 4,108,563 | 8/1978 | Brown et al. | 403/347 |
| 4,264,231 | 4/1981 | Rosenbaum | 403/347 |
| 4,317,641 | 3/1982 | Sauer | 403/347 |
| 4,471,596 | 9/1984 | Deaton et al. | 52/668 |
| 4,494,350 | 1/1985 | Sharp | 52/665 |
| 4,499,697 | 2/1985 | LaLonde | 52/98 |
| 4,543,759 | 10/1985 | Rohrer | 52/475 |
| 4,548,013 | 10/1985 | Briceno | 52/667 |
| 4,601,153 | 7/1986 | Dunn et al. | 52/666 |
| 4,611,453 | 9/1986 | Worley | 52/667 |
| 4,621,474 | 11/1986 | Worley | 52/667 |
| 4,625,470 | 12/1986 | Heritage | 52/28 |
| 4,648,229 | 3/1987 | Limp | 52/484 |
| 4,648,230 | 3/1987 | Mieyal et al. | 52/667 |
| 4,660,348 | 4/1987 | LaLonde | 52/762 |
| 4,680,910 | 7/1987 | Perk | 52/489 |
| 4,712,350 | 12/1987 | Vukmanic | 52/484 |
| 4,779,394 | 10/1988 | Shirey et al. | 52/667 |
| 4,785,603 | 11/1988 | Platt | 52/667 |
| 4,827,681 | 5/1989 | Platt | 52/90 |
| 4,850,172 | 7/1989 | Gailey et al. | 52/665 |
| 4,852,325 | 8/1989 | Dunn et al. | 52/729 |
| 4,912,894 | 4/1990 | Platt | 52/98 |
| 4,989,387 | 2/1991 | Vukmanic et al. | 52/667 |
| 5,044,138 | 9/1991 | Zaccardelli et al. | 52/667 |

*Primary Examiner*—Creighton Smith

*Attorney, Agent, or Firm*—Pearne, Gordon, McCoy & Granger

[57] ABSTRACT

A connector for suspended ceiling grid that provides a first end lock in a main tee slot and a lock with an identical opposed connector. The connector in the first end lock and in the connector-to-connector lock is installed with a simple stab-in motion. The connector works with a non-re-entrant slot profile that avoids the risk of improper assembly. The connector is releasable without tools and is reusable. The connector emits an audible click when fully installed, is resistant to damage from rough handling, and affords high tensile and compressive strength in its connections.

18 Claims, 6 Drawing Sheets

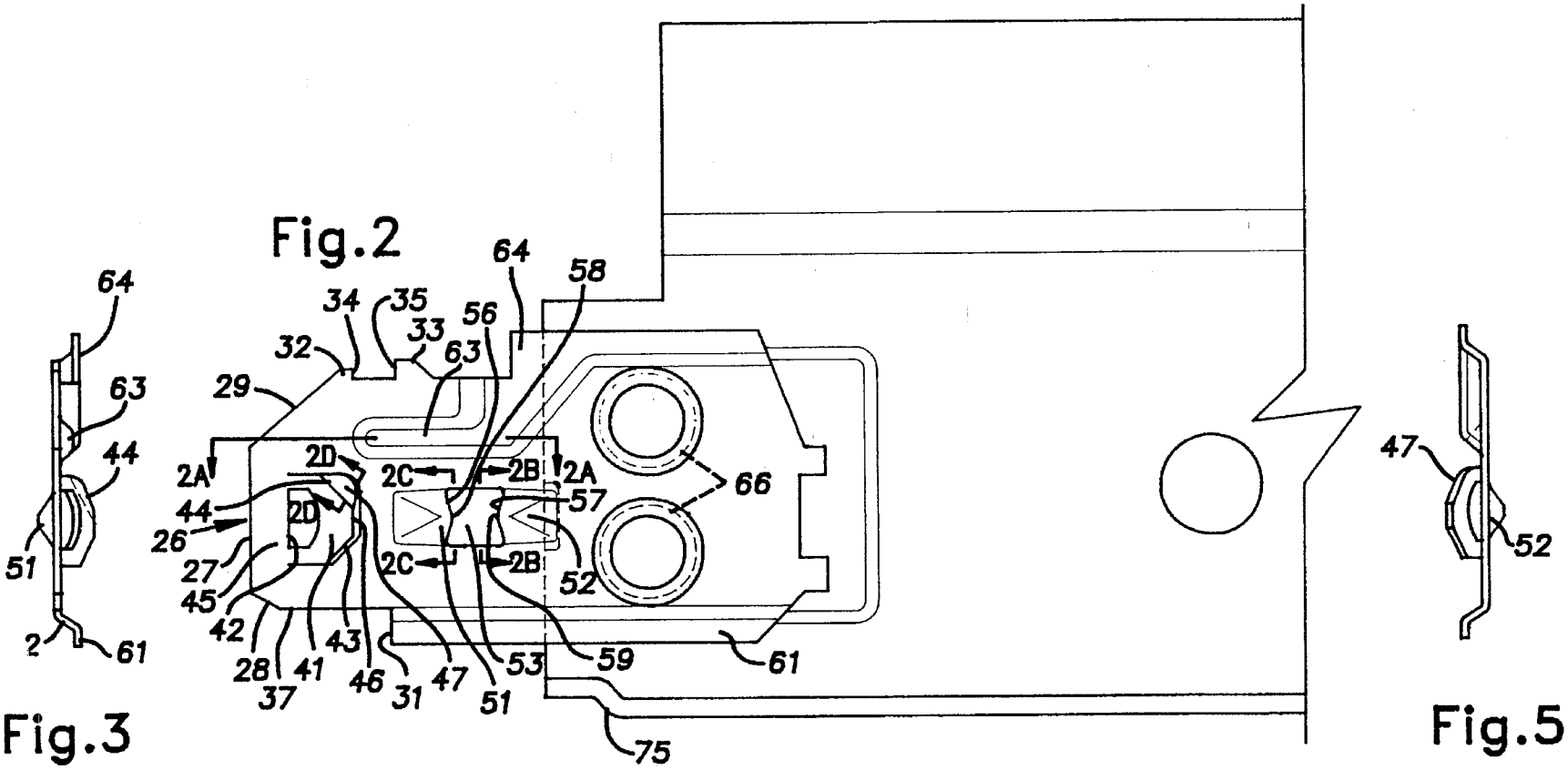
Fig.5
Fig.2
Fig.3
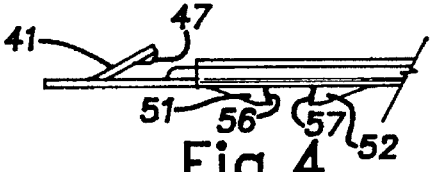
Fig.4

STAB-IN REMOVABLE END CONNECTOR

BACKGROUND OF THE INVENTION

The invention pertains to grid for suspended ceiling construction and, in particular, to an improved end connection for such grid.

Suspended ceilings are typically provided with a supporting grid work of main runners and cross runners. Ordinarily, the runners have the form of an inverted "T" and are thus called main tees and cross tees. Conventionally, a cross runner end connects at a hole or slot in the main runner with the main runner and, in tandem, with another cross runner end. The holes are located with a regular spacing along the length of the main runner establishing the pattern of the grid, i.e. the center-to-center spacing of the cross runners. The great majority of connections in the construction of a ceiling grid are of the cross runner end type.

Primary factors in the commercial acceptance of a cross runner connector are the ease with which it can be reliably interconnected and, to a lesser but important extent, the ease by which it can be disconnected. A variety of end connector designs have been proposed to the industry to facilitate the original erection of a grid and its potential removal for various purposes such as the correction of errors, last minute architectural changes, and access for later installed equipment including plumbing, heating, air conditioning, wiring and the like. Examples of prior art connectors are shown in U.S. Pat. Nos. 4,108,563, 4,611,453 and 4,779,394.

SUMMARY OF THE INVENTION

The invention provides a connector for ceiling grid cross runners that is easy to install and that can be removed without tools even after full assembly into a trapped module condition. The disclosed connector establishes a first end lock with the slot of the main runner and then a runner-to-runner lock when an identical connector of an opposed cross runner is assembled in the slot from the opposite side. The connector for both the first end lock and the lock with the opposed cross runner is installed with a simple stab-in motion. This effort requires no extraneous motion such as a hook-in manipulation of the connector and the runner carrying it. The disclosed connector cooperates with a simple slot or hole configuration that has a single cell or pod so that the connector cannot be inadvertently caught in the wrong side of the slot. The first end lock is sufficient in strength to support its cross runner in a cantilever mode until the free end of this runner can be set in place thereby affording greater productivity and reduced risk of product damage or loss from accidental fall out. The runner-to-runner lock, sometimes called the connector-to-connector lock, of the disclosed connector produces precise grid dimensions and high connection strength.

In accordance with the invention, both the elements that provide the first end lock and the elements that provide the connector-to-connector lock are releasable without tools by simple hand manipulation of the main runner relative to the cross runner.

Besides the foregoing attributes, it is an object of the invention to provide the following features: low requisite skill level on the part of the installer, reusability, assured quality, and assured building code compliance for seismic and fire rated applications. The requisite skill for installation is of a low level because, in addition to the features mentioned above, an audible click is produced when a connector is fully inserted and, at the same time, full assembly can be visually assured.

DESCRIPTION OF THE PREFERRED EMBODIMENT

Figure 1:
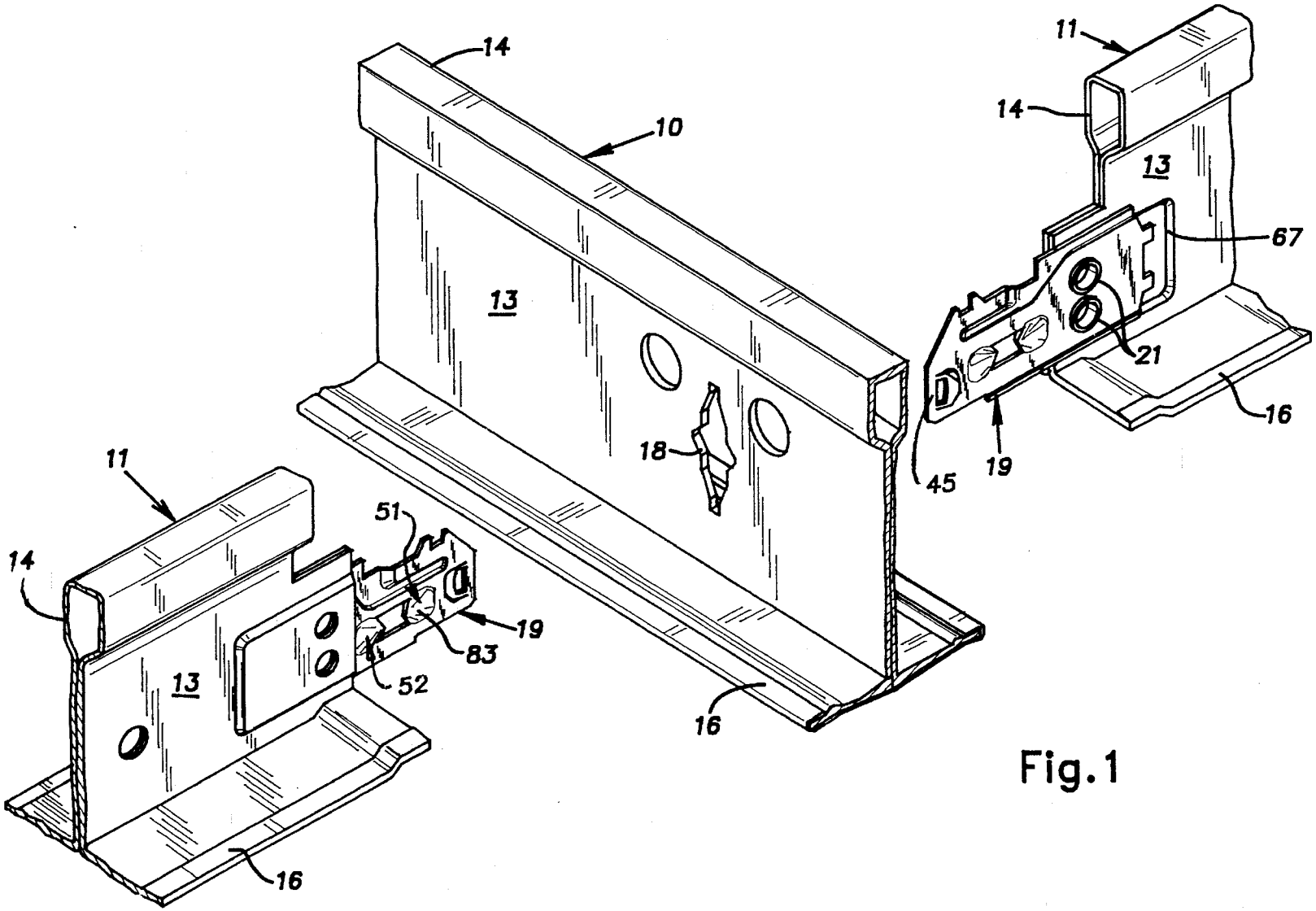
FIG. 1 is a fragmentary perspective view of the ends of an opposed pair of cross runners with end connectors and aligned with a receiving slot in a main or through runner.

FIG. 1 illustrates a portion of a main or through runner 10 and cross runners 11 forming intersections in a suspension ceiling grid system in accordance with the present invention. In the illustrated embodiment, all of the runners 10 and 11 are tees formed with a central web 13, a stiffening bulb 14 along one edge of the web 13, and oppositely extending panel supporting flanges 16 along the lower or opposite edge of the web. Ordinarily, the runners 10, 11 are assembled with their longitudinal axii lying in a horizontal plane and their webs 13 lying in vertical planes. It should be understood, however, that in accordance with the broader aspects of the invention, the disclosed connecting structure can be applied to other forms of grid tees or runners and that the particular tee structure is illustrative of one preferred embodiment of this invention. It should be further understood that the grid tees are typically formed of thin sheet metal which is bent to the cross section illustrated. However, in accordance with the invention, the grid tees can be formed in other ways, e.g. by extrusion or the like.

In many grid systems for suspension ceilings, a horizontal array of parallel, laterally spaced main tees or runners are supported from the building structure above the grid by wires or the like, and cross tees or runners interconnect with the main runners, with two opposed cross runner ends positioned on opposite sides of the main runner at each intersection. However, this invention is also applicable to basket weave type grid systems in which main runs and cross runs are not provided, strictly speaking. Both types of grid systems, however, provide intersections in which a through runner extends past opposed runner ends which interconnect with the through runner at intersections. Therefore, as used herein, the term "through runner" is used instead of "main runner" so as to encompass basket weave grid systems, main run and cross run grid systems, and other types of grid systems which may incorporate the present invention.

Typically, the runners of a suspension ceiling grid system are interconnected to form rectangular or square openings bounded by flanges 16. Ceiling panels or fixtures such as lights and air vents are then positioned in such openings and are supported around their periphery by the associated flanges 16.

Figure 7:
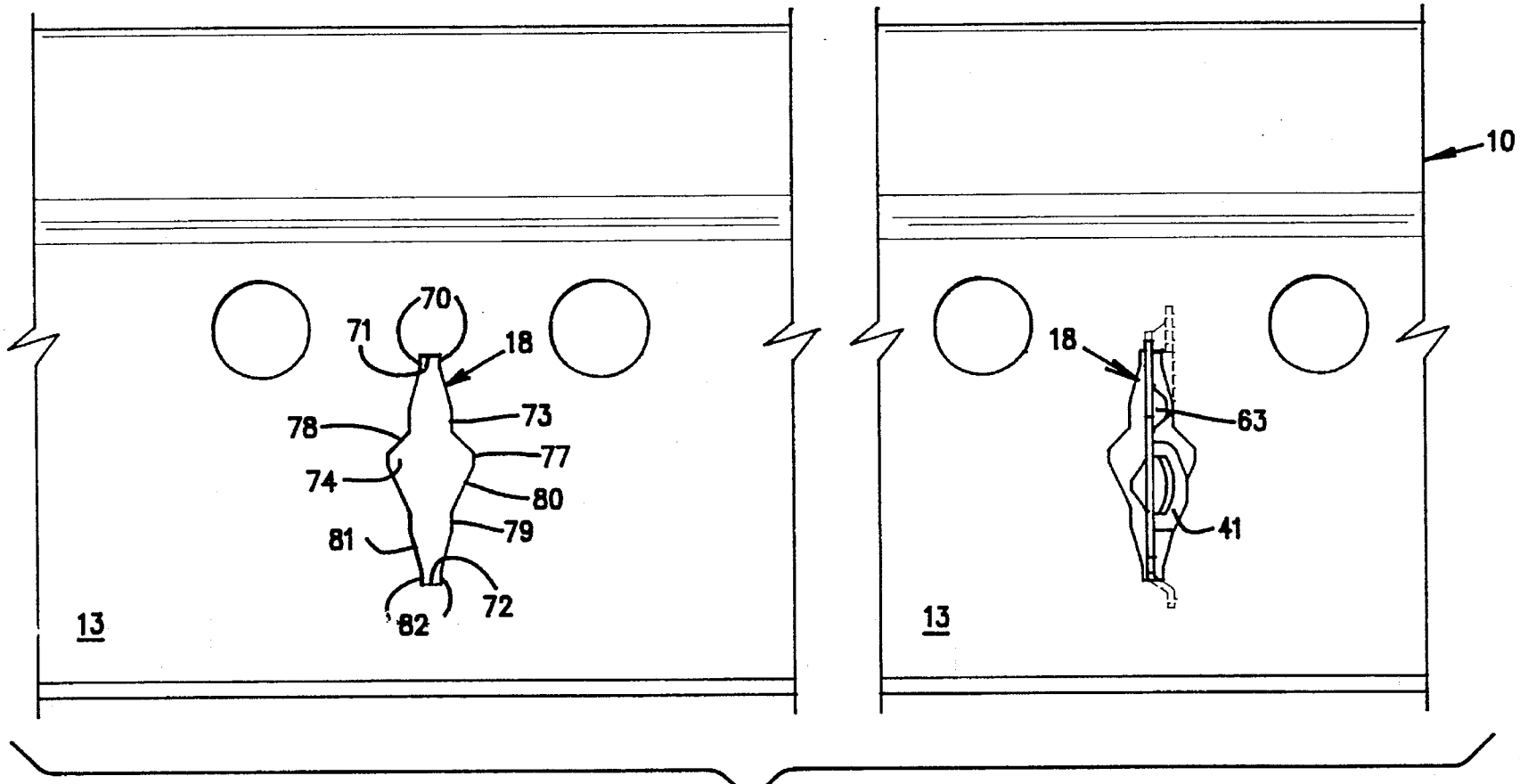
FIG. 7 is a fragmentary elevational view taken in the plane indicated by the lines 7—7 in FIG. 6 of the connector assembled in the respective slot of the main runner as well as an adjacent slot without a connector.

Referring particularly to FIGS. 1 and 7, the web 13 of the through runner 10 is formed with a connector opening 18, and the ends of the two cross runners 11 are provided with identical connectors 19. In the illustrated embodiment, the connectors 19 are formed of separate elements and are connected to the webs 13 of the runner ends by a clinch-like connection 21 known in the art.

Figure 8:
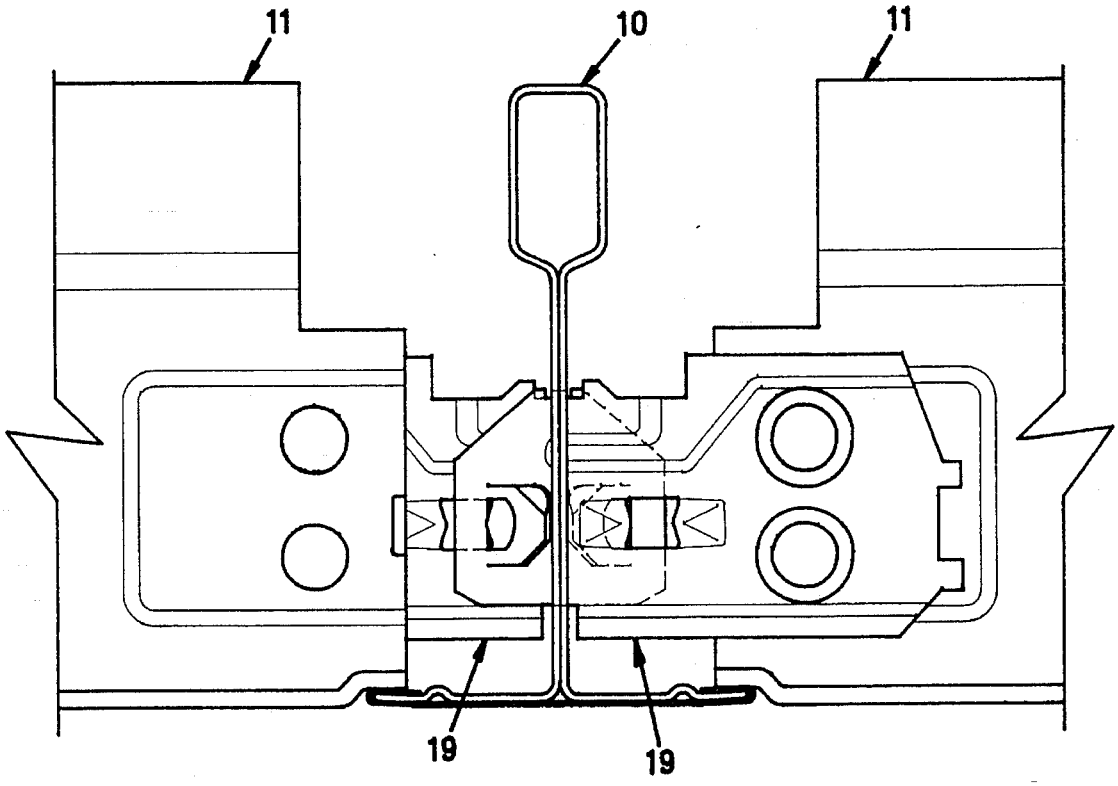
FIG. 8 is a view similar to FIG. 6 showing a pair of opposed connectors assembled and locked together in a main runner slot.
Figure 6:
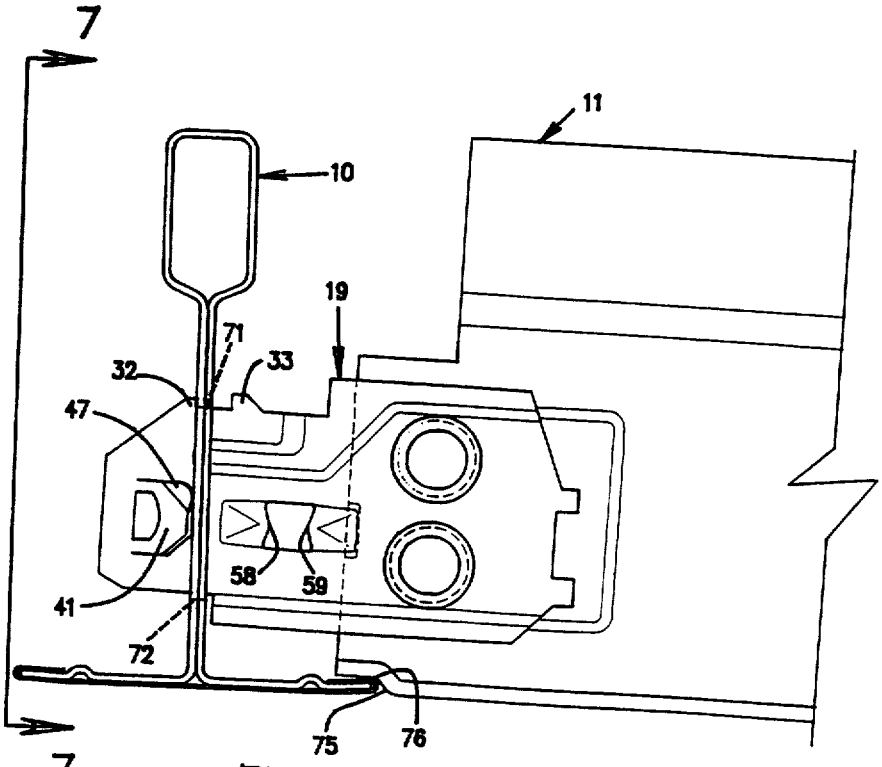
FIG. 6 is a side elevational view of a first cross runner connector inserted into the slot of a main runner.
Figures 2, 3, 4, 5:
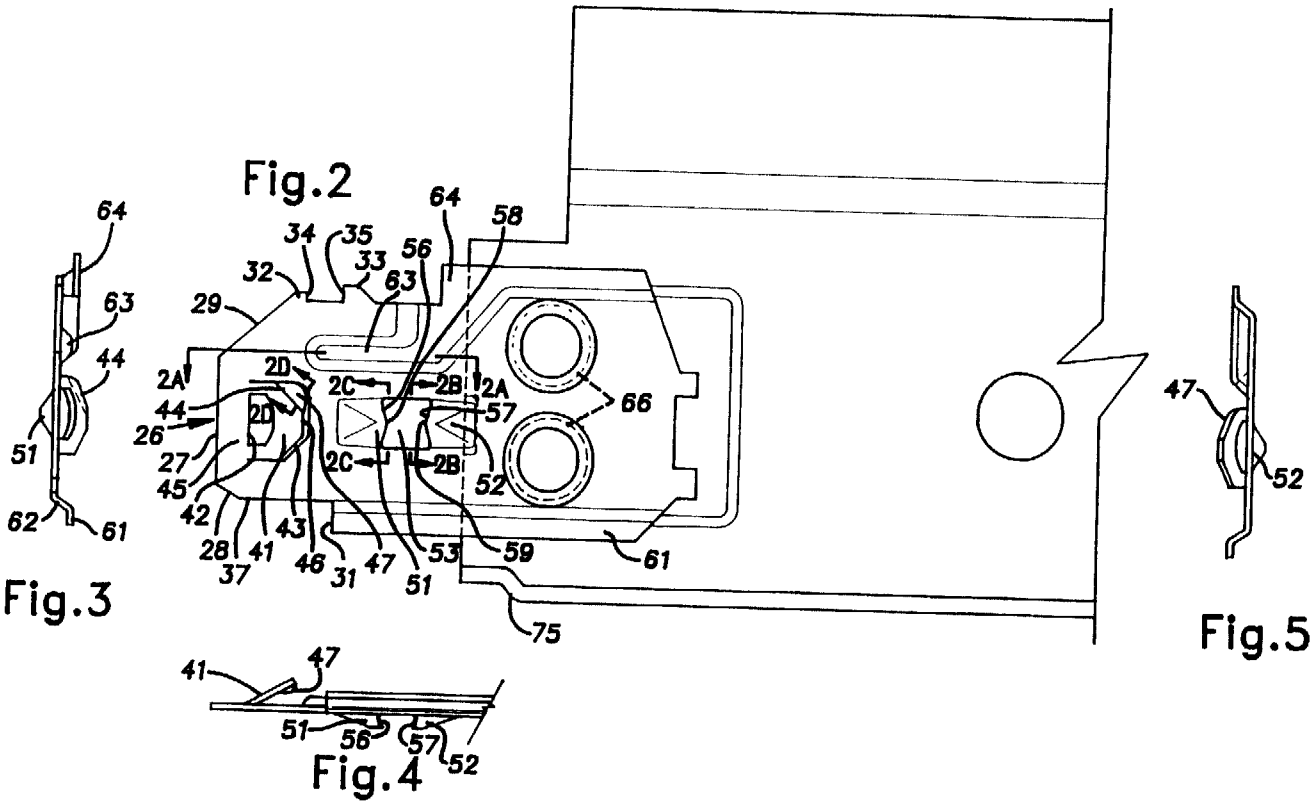

FIG. 1 illustrates the runners before either connector is installed in the opening 18. FIGS. 6 and 7 illustrate the condition after the connector 19 of the first runner end is installed in the opening 18 and is held therein by the first end lock discussed below. FIG. 8 illustrates a completely assembled intersection of two runners 11 and the through runner 10.

A connector 19 is preferably stamped from high strength steel. Major surface areas of the connector 19 retain their original planar configuration and represent the plane of the connector body while other areas described below are stamped out of the original plane. The connector 19 which in use normally lies in the vertical plane of its runner web 13, has a lead end 26 with an irregular, somewhat angular profile. The lead end 26 includes a generally vertical lead edge or nose 27, a lower minor bevel 28 and a major upper bevel 29; the bevels 28, 29 facilitate insertion of the connector 19 into the slot 18 of the through runner 10. A lower edge 31, lying in a vertical plane transverse to the plane of the connector, is adapted to abut the web 13 of the through runner 10. Along its upper edge, the connector 19 includes a pair of projections 32, 33 providing opposed abutment or stop edges 34, 35 facing rearwardly and forwardly, respectively. The rear edge 34 of the forward projection 32 is spaced horizontally from the lower vertical edge 31 a distance at least as great as the thickness of the web 13 of the through runner 10. The forward edge 35 of the rear projection is spaced slightly rearwardly of the lower edge 31 so that with respect to the forward projection 32, it also provides for the thickness of the through runner web 13. The height of the forward projection 32 above a lower edge 37 of the lead end 26 is less than the height of the slot 18 so that the projection 32 does not hinder insertion of the lead end into the slot. As will become apparent, when the connector 19 is installed, the web 13 of a through runner is positioned between the front projection 32, at one side, and the lower edge 31 and rear projection 33 to the other side.

A generally U-shaped flag or lock tab 41 is lanced from the plane of the connector 19. The interior profile of the tab 41 is formed by a D-shaped hole that has a straight vertical edge 42 at a predetermined spacing from the lead edge 27 so as to leave a strap 45 therebetween of fixed horizontal width. The tab 41 extends rearwardly and laterally outwardly (above the plane of the drawing of FIG. 2) from a base or bend line that is generally coincident with the hole edge 42. The free end of the tab 41, remote from its base adjacent the edge 42, has an upwardly angled lower edge 43 and a downwardly angled bend line 44 mutually converging toward a rearward vertical edge 46. A flap section 47 of the tab 41 generally rearward of and above the bend line 44 is bent inwardly to return towards the plane of the connector 19. The free edge 46 of the tab 41 is generally in the same imaginary vertical plane, transverse to the plane of the connector 19, as is the rear edge 34 of the forward projection 32.

Spaced rearwardly of the lock tab 41 is a pair of oppositely facing locking projections 51, 52 formed from the plane of the connector 19 to a side opposite that from which the tab projects. The projections 51, 52 are spaced from one another by an hour glass shaped hole 53. The projections 51, 52 are essentially mirror images of one another with each having a configuration loosely resembling three sides of a pyramid. The rearward projection 52 can be slightly larger in its extension from the plane of the connector 19. Edges 56, 57 of the projections 51, 52 formed by the hole 53 are out of plumb with respect to a vertical line so that they form a point or apex 58, 59 as viewed, for example, in FIG. 2 and FIG. 4 and so that they present a slight undercut with reference to the rearward and forward directions from their respective points 58, 59. The horizontal spacing between the projection points 58, 59 is desirably just slightly larger than the horizontal width of the strap 45. As shown, the hole 53 has the same elevation as the strap 45.

Figures 2, 3, 4, 5:
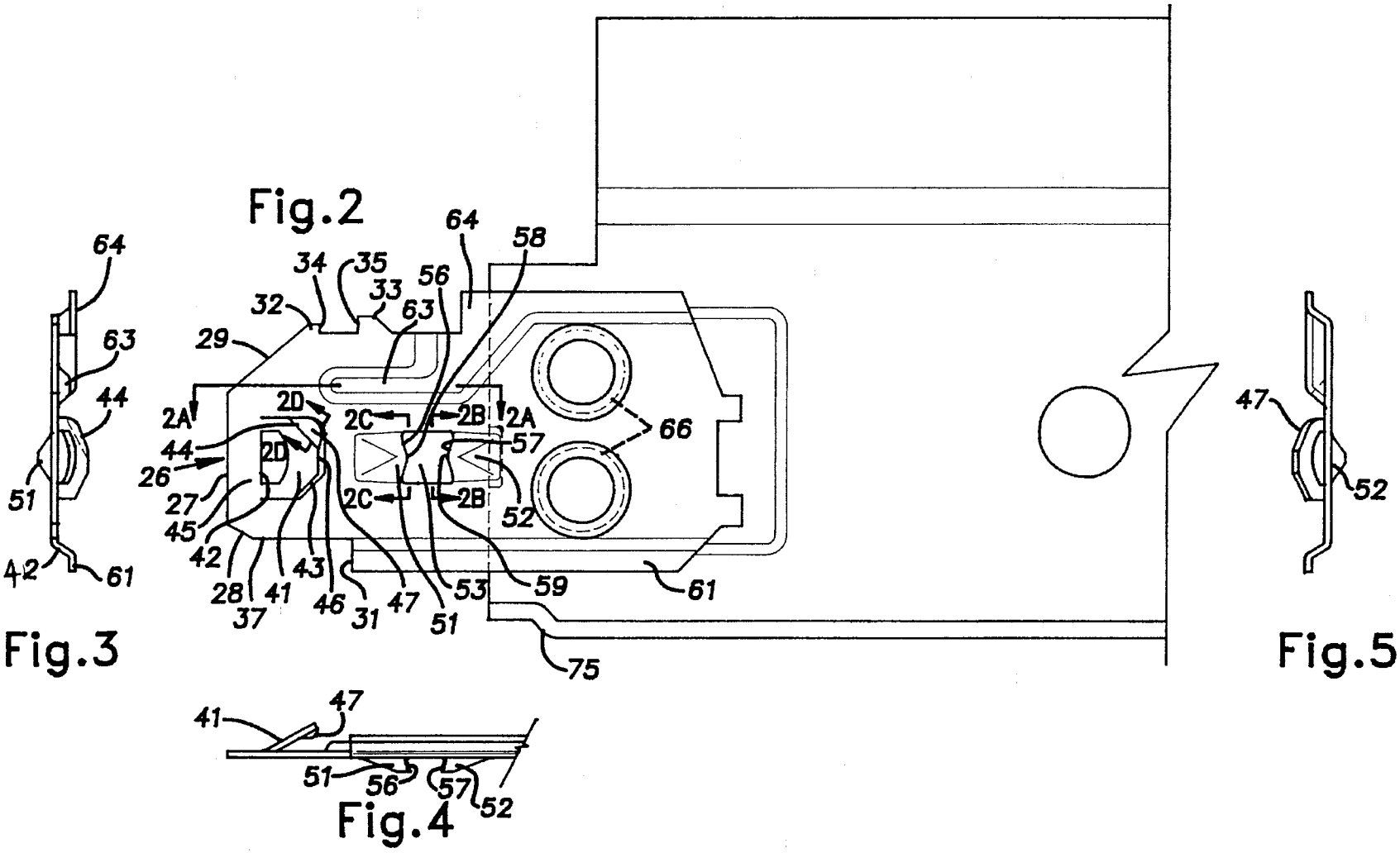
FIG. 2 is a side elevational view of a typical connector, shown in FIG. 1, and an associated portion of its runner.
FIG. 3 is a front end elevational view of the connector.
FIG. 4 is a fragmentary bottom view of the connector.
FIG. 5 is a rear elevational view of the connector.

Along its bottom, the connector 19 is formed with a longitudinal stiffening flange 61 created by stamping the relevant area out of the plane of the connector to the side where the tab 41 is located. The flange 61 lies in a vertical plane and is connected to the main portion of the body of the connector 19 by a laterally downwardly slanted web area 62 (FIG. 3). The forward extent of the flange 61 and web 62 form the edge 31. A stiffening rib 63 is embossed in the body of the connector 19 above the locking projections 51, 52 to the side carrying the tab 41. The rib 63 extends longitudinally, i.e. horizontally, from the zone between the projections or stops 32, 33 to a zone between the projections 51, 52 where it merges with a stiffening flange 64. The flange 64 has a side profile that slants upwardly from the rib 63 and then longitudinally like the lower flange 61. The rib 63, which in assembly with the through runner 10 extends through the plane of the through runner web 13, works with the flanges 61, 64 to increase the compressive and bending strength of the connector to reduce damage from rough handling or seismic shock.

Two vertically aligned holes 66 are punched in the rear portion of the connector 19 to enable it to be joined to a runner end 11 at the clinch-like connections 21. Preferably, the end of each runner 11 is embossed with a shallow pocket 67 having dimensions large enough to receive the rear portion of the connector 19. The lateral depth of the pocket is sufficient to generally make the associated runner 11 laterally centered with the slot 18.

The slot 18 which is elongated in the vertical direction has a polygonal profile with a central plane of symmetry. At its upper and lower ends, the slot 18 has short sides or ends 71, 72 respectively. At the upper end or short side 71, the slot 18 has opposed vertical sides 70 from which it diverges outwardly to an intermediate width formed by two opposed vertical sides or edges 73. A mid-section 74 of the slot is formed, with reference to a downward vertical direction, by diverging edges 78, parallel vertical edges 77 and converging edges 80. The lower section of the slot 18 includes vertical edges 79, converging edges 81 and vertical edges 82. The spacing of the edges 70 and 82 respectively at each end of the slot 18 is proportioned to closely confine the thickness of the sheet stock of two connectors 19. The mid-section 74 represents the major width area of the slot 18. While the illustrated slot 18 has its profile formed as a polygon, equivalent arcuate segments can be used to achieve desired results.

A first runner 11 is connected to a through runner 10 by inserting the lead end 26 of its connector 19 into a selected slot 18. More specifically, this insertion technique involves a stab-in motion essentially limited to translation along the longitudinal or horizontal axis of the runner 11. Hook-like motion, rocking motion or other extraneous non-translation motion is unnecessary. The connector 19 is thrust into the slot 18 until the lead edge 35 of the trailing projection 33 abuts the web 13 immediately above the slot end 71. During this motion, the tab or flag 41 bears against the side of the slot 18 in the mid-section 74 and by camming action therewith is squeezed toward the plane of the main body of the connector 19 until it passes fully through the slot 18. At this point, the tab 41 snaps back into its free configuration emitting an audible click essentially simultaneously with the seating of the projection edge 35 against the through runner web 13. The audible click assists the installer in ascertaining that the connector 19 has been fully installed. This condition is illustrated in FIGS. 6 and 7. As shown in FIG. 7, the slot 18 and tab 41 are configured so that regardless of the lateral position of the connector 19 in the slot, the free vertical edge 46 of the tab is laterally outside of at least portions of the slot so that the connector 19 is locked or caught on the web 13 of the through runner 10 because the tab 41 under ordinary axial forces cannot simply move axially back out of the slot.

Still with reference to FIG. 6, a single connector 19 in the slot 18 provides a so-called first end lock capable of supporting the associated runner 11 as a cantilever from the through runner 10. The tab 41 locked on the far side of the through runner web 13 is capable of supporting the runner 11 against axial pull-out forces occasioned by an ordinary cantilever condition. Pivoting motion about a contact area, indicated at 76 in FIG. 6 between an offset 75 of the cross runner flange 16 and the through runner flange 16, in a cantilever condition, causes the connector 19 to rise slightly in the slot 18 and, consequently, the projection edge 34 to contact the adjacent face of the web 13 immediately above the slot. This contact prevents further pivotal movement contributing to the first end lock and the connector's assured resistance to ordinary cantilever forces. The described ability of the connector 19 to provide cantilever support of the associated runner 11 is very helpful in the installation of a ceiling grid since it allows the runner to be temporarily supported at one end until the installer has an opportunity to connect the opposite end (not shown) of the relevant runner, typically, to another through runner. It will be understood from the foregoing disclosure with reference particularly to FIG. 7, that the connector 19 cannot be improperly assembled in the simple slot 18 as may be the case where a receiving slot is H-shaped or otherwise re-entrantly configured with pods or pockets that can trap a connector on the wrong side of such slot.

A second runner 11 is connected to the through runner 10 by inserting its connector 19 into the slot 18 occupied by the first connector 19. In the illustrated design, the second connector 19 is inserted in the slot 18 to the left of the first connector 19 (when viewed from a reference point associated with the main part of this second runner being installed). Again, this installation is accomplished by a stab-in motion parallel to the longitudinal or horizontal axis of the runner being installed. Besides effecting a lock of the associated tab 41 through the slot 18 (with an audible click), the assembly motion of the second connector 19 produces a connector-to-connector lock sometimes referred to as "hand shaking". This condition is depicted in FIG. 8 where it can be seen that upon full assembly of both connectors 19 in a slot 18 (with their stop edges 35 abutting or close to the faces of the web 13), the strap 45 of one connector 19 is received and locked between the projections 51, 52 of the other connector and vice versa. This result is achieved by the pyramid configuration of the lead or front projection 51; a face 83 (FIG. 1) of each projection 51 works as a cam to deflect the advancing strap 45 of the opposite connector laterally outwardly and past this first or lead projection 51 until the strap is able to snap back into its plane and between the opposed projections 51, 52 of the receiving or opposite connector.

A study of FIG. 7 reveals that when contact between the rib 63 and the adjacent vertical slot edge 73 is established, the connector 19 is confined laterally. Thus, when two connectors 19 are assembled in the same slot 18, significant lateral movement is prevented and the connectors are snugly held laterally against one another and a precisely controlled module length is achieved throughout a ceiling grid. This confinement assures that the straps 45 are held in the space between pairs of projections 51 and 52 for a reliable connection.

As discussed earlier, the width of the strap 45 in the longitudinal direction of the runner 11 is just slightly less than the gap between the points or apexes 58, 59 of the projections so that the connectors 19 and their associated runners 11 are precisely positioned relative to one another. On each side of the through runner web 13, a strap 45 is restrained in tension and compression by the adjacent projections 51, 52. An exceptionally high restraining force level is achieved by the undercut provided by the receding or non-plumb edges 56, 57. This high restraining force results from the tongue and groove configuration provided by the strap 45 and projections 51, 52, respectively. In particular, the strap 45 acting as a tongue under a generally axial force between joined connectors extends into a generally vertical groove or undercut laterally underlying each of the projection points 58 or 59 resulting from the angularity or out of plumb orientation of the edges 56, 57. By extending into such a groove or recess the strap and adjacent portions of the connector are positively gripped and prevented from bending laterally out of abutting contact with the opposed connector.

It will be understood that each of the runners 11 ordinarily has a connector 19 identical to that disclosed herein on the end opposite that shown in the figures.

Occasionally, it becomes necessary to remove a connector 19 of a cross runner 11 from the slot 18 of a through runner 10 as in the case where an error has been made in the original assembly or where remodeling and reconstruction is performed.

Figure 9:
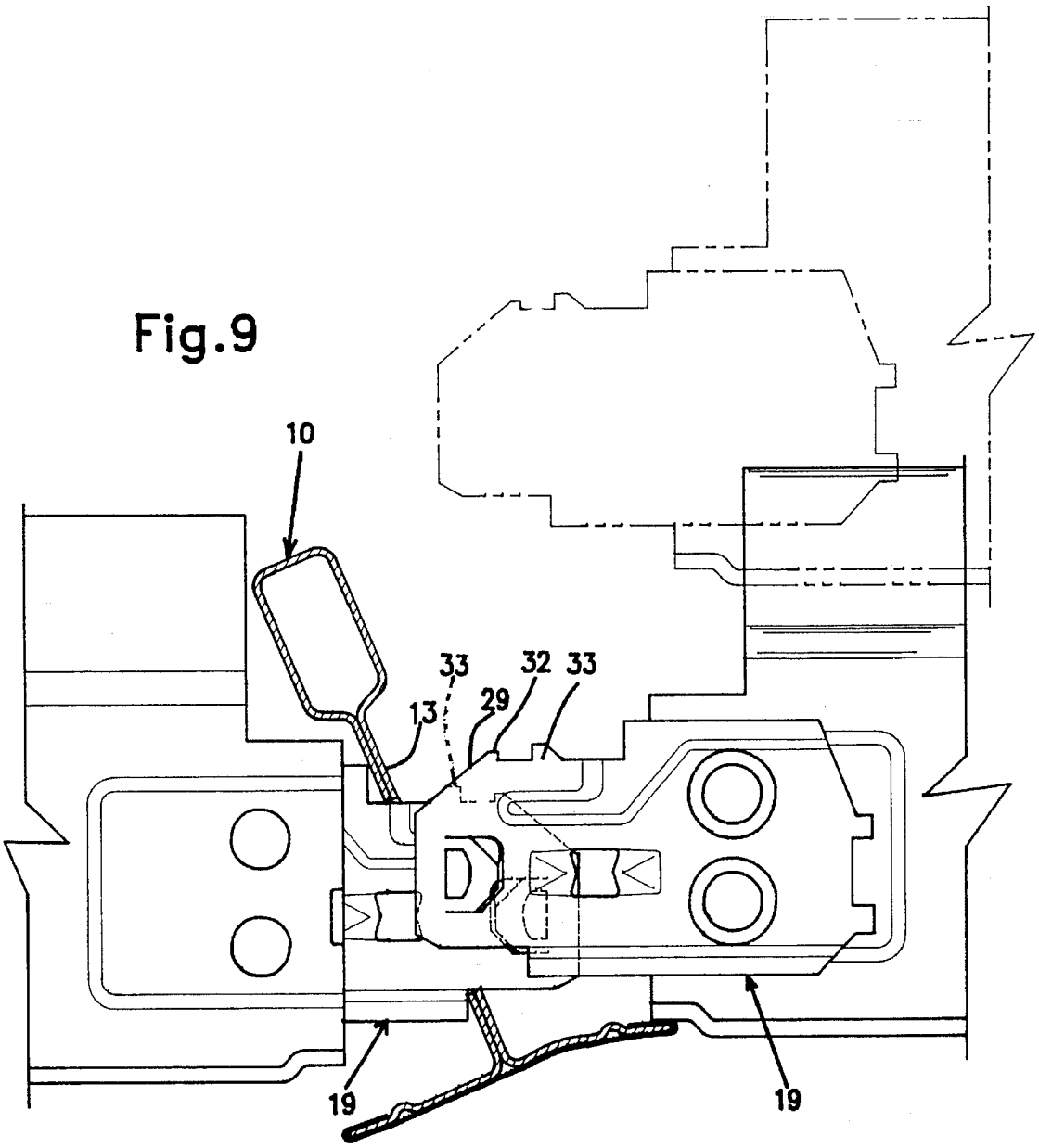
FIG. 9 is a view similar to FIG. 8 but with the runners being forcibly displaced for the disassembly of one of the connectors and its cross runner.
Figure 2A:
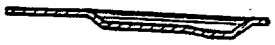
FIG. 2A is a fragmentary sectional view of the connector taken in the plane at the lines 2*a*—2*a* indicated in FIG. 2.
Figure 2B:
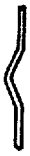
FIG. 2B a fragmentary sectional view of the connector taken in the plane at the lines 2*b*—2*b* indicated in FIG. 2.
Figure 2C:
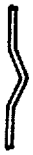
FIG. 2C is a fragmentary sectional view of the connector taken in the plane at the lines 2*c*—2*c* indicated in FIG. 2.
Figure 2D:
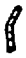
FIG. 2D is a fragmentary sectional view of the connector taken in the plane at the lines 2*d*—2*d* indicated in FIG 2.

With reference to FIG. 9, there is shown a manner by which a connector 19 and its associated runner 11 may be disassembled from a fully installed condition with a through runner and a connector 19 of an opposed runner 11. It will be understood that the depiction in FIG. 9 is that of the situation where the runner 11 to be removed is in a so-called trapped module condition where its ends, at the beginning of the removal process, are each fully assembled with an opposed connector and a through runner. Initially, for disassembly, the associated through runner 10 is twisted on its longitudinal axis towards the inclined temporary position illustrated in FIG. 9. In order for the through runner 10 to reach this position, it is necessary for the projection or stop 33 of the connector 19 on the left in FIG. 9 to cut through the material of the web 13 of the through runner in the local area of the slot end 71. This is readily accomplished manually without tools particularly where, as disclosed, the connector 19 is of a high strength material and is harder than the metal material comprising the through runner web 13. As shown, the height of the connector to the rear of the projection 33 is reduced to receive the temporarily twisted through runner web 13.

As the through runner 10 is being twisted and cut by the projection 33, the inwardly bent flap section 47 of the tab 41 enters the relatively wide mid-section 74 of the slot 18. The configuration of the slot profile formed by the edges 78, 77 and 80 and the re-entrant or bent-in orientation of the flap section 47 permits the flap section following the twisting of the through runner to resiliently cam the tab 41 laterally inwardly towards the center of the slot thereby permitting the tab to pass back out through the slot.

With the through runner 10 twisted or cocked to the position indicated in FIG. 9 it will be understood that the connector 19 of the runner 11 on the right is enabled to move upwardly with respect to the connector 19 of the opposed runner 11 since the former connector, by virtue of the clearance provided by its bevel 29, is not confined by the top edge 71 of the slot 18. Vertical relative movement of the connectors 19 allows the straps 45 of each of the connectors to move out of the pockets formed by the projections 51, 52 of the other connector as the result of a camming action where the face of one connector slides across the faces of the projections 51, 52 of the other connector. At this point the projections 51, 52 release their connection of the other connector and, as a result, the rightward runner 11 is released from both the opposed runner 11 and the through runner 10. The runner 11 can be completely released by performing a similar operation at its opposite end (not shown).

It will be understood that the release or removal of a connector 19 from the opposite connector 19 to which it is coupled and the slot 18 of the through runner 10 is accomplished without tools. It can also be understood that, likewise without tools, a first end connection or lock, i.e. where only one connector 19 exists in a slot 18, can be released from the slot 18 by manually manipulating the cross runner relative to the through runner so that a condition similar to that of FIG. 9 is approached and the flap section 47 is enabled to cam the tab 41 laterally inwardly and allow it to escape from the slot. It will be understood that when the through runner 10 is tilted or twisted about its longitudinal axis, the flap section 47 of the tab 41 is disposed at a point where it will readily enter the major opening area 74 of the slot and as the twisting motion continues, the tab 41 is cammed inwardly until, ultimately, the edge 46 can pass completely out of the slot and the connector 19 is released. In the case where only a single connector 19 exists in a slot 18 and the associated cross runner is cantilevered, it may be removed by its own manipulation without significant twisting of the through runner so long as the relative angular positions of the through runner web and the cross runner are caused to approach their relative oblique condition illustrated in FIG. 9. In twisting the through runner 10, and/or downwardly rotating the cross runner 11 to be removed in the case of a first end lock, it may be necessary to resiliently deflect the flange 16 under the connector 19 downwardly and may be necessary for the projection 32 to slightly cut through the through runner web above the slot 18 for proper release. In all cases of cross runner removal, the through runner 10 and connector 19 are left in a state where they can be re-used with essentially full functionality except for the possible loss in a cut slot of cantilever support of a cross runner.

The capability of the disclosed connector to effect a connection by a simple stab-in motion allows the installer to work from either below or above the plane of the ceiling. This capability thus offers greater flexibility to the installer. The ability to remove the connector without tools is an advantage to the installer because it can be accomplished in less time and with less effort than ordinarily expended with prior connector designs.

It should be evident that this disclosure is by way of example and that various changes may be made by adding, modifying or eliminating details without departing from the fair scope of the teaching contained in this disclosure. For example, with a runner made of appropriate material the connector can be integrally formed with the runner web. The projection 33 can be arranged to break or bend out of the way of the through runner web 13 when the latter is forcibly twisted to release a cross runner. The invention is therefore not limited to particular details of this disclosure except to the extent that the following claims are necessarily so limited.

We claim:

1. A connector for a ceiling grid cross runner formed from a body of planar sheet metal stock, the connector being adapted to be assembled with horizontal movement into a vertically oriented slot formed in a vertical web of a through runner, the connector having a tab lanced from and extending laterally of the plane of the body in a free condition, the tab being resiliently deflectable laterally inwardly by engagement with the side of the slot to enable a portion of the connector including the tab to pass through the slot in the through runner when the connector is forced into the slot and being capable of springing back towards its free condition, the tab, in its free condition, after passing into the slot, being arranged to normally prevent the connector from being moved rearwardly out of the slot when the web of the through runner is in the normal vertical orientation and a runner to which the connector is fixed extends in a horizontal direction in transverse relation to the through runner web, and a cam element operable when the plane of the through runner web and the runner to which the connector is fixed are displaced from a transverse relation to compress the tab laterally inwardly and enable it to be pulled rearwardly back through the runner opening.

2. A connector set forth in claim 1, wherein the cam element is integral with the tab.

3. A connector as set forth in claim 2, wherein the cam element is formed by an inwardly bent portion of the tab.

4. A connector as set forth in claim 1, wherein the connector includes elements for interengaging and releasably locking with an identical connector assembled through the same slot from an opposite side of the through runner web.

5. A suspension ceiling grid system comprising elongated grid runners interconnected at intersections including a through runner and two opposed runners, said runners each including a vertical web, an elongated vertically extending slot in the web of the through runner, and an identical generally planar end connector on an end of each of said opposed runners projecting into said slot from opposite sides thereof, the slot having opposed sides that provide a width sufficient to receive both of said connectors in laterally abutting relation, the connectors each being arranged with respect to the slot to provide a first end lock with said slot, the slot having a configuration that avoids the risk of receiving and laterally restricting a connector to an incorrect one of its sides, said slot and connectors having respective configurations that allow the connectors to each be installed in said slot with a stab-in motion and to each be removed from said slot by relative manipulation of said through runner and its associated runner to release said first end lock without tools.

6. A suspension ceiling grid system as set forth in claim 5, wherein each connector and the slot are arranged to release said first end lock by manually manipulating the through runner relative to the associated runner to dispose the web of the through runner in a plane oblique to the longitudinal direction of the associated runner.

7. A suspension ceiling grid system as set forth in claim 5, wherein the first end lock includes a tab projecting in a free condition laterally outwardly from the plane of the connector and adapted to be resiliently compressed towards the plane of the connector to pass through the slot when the connector is inserted in the slot, said tab being arranged to snap back into its free condition after passing through said slot to normally prevent said connector from being pulled out of said slot.

8. A suspension ceiling grid system as set forth in claim 7, wherein said tab includes a flap bent inwardly towards the plane of the connector, said flap providing a camming action to compress said tab towards the plane of the connector when the plane of the through runner web is displaced into an oblique relation to the associated runner.

9. A suspension ceiling grid system as set forth in claim 8, wherein said connector includes mutually engaging elements that produce a connector-to-connector lock.

10. A suspension ceiling grid system as set forth in claim 9, wherein said mutually engaging elements are arranged to provide both tensile and compressive interlocking.

11. A suspension ceiling grid system as set forth in claim 5, wherein the slot is narrow at opposite vertical ends and is widened at a mid-section between said ends.

12. A suspension ceiling grid system comprising elongated grid members interconnected at intersections including a through runner and two opposed runners, said runners each including a vertical web, an elongated vertically extending slot in the web of the through runner, and an identical generally planar end connector on an end of each of said opposed runners projecting into said slot from opposite sides thereof, the slot having opposed sides that provide a width sufficient to receive both of said connectors in laterally abutting relation, each connector being arranged to interlock with the other connector when both are received in said slot, the slot having a configuration that avoids the risk of receiving and laterally restricting a connector at a wrong one of its sides, said slot and each connector having respective configurations that allow the connector with its associated runner to be installed in said slot with a stab-in motion and be removed from said slot by relative manipulation of said through runner and the associated runner to release the interconnection of said connectors without tools.

13. A suspension ceiling grid system as set forth in claim 12, wherein the connector and slot are arranged to release the connector-to-connector lock by manually manipulating the through runner relative to the associated runner to dispose the web of the through runner in a plane oblique to the longitudinal direction of the associated runner.

14. A suspension ceiling grid system as set forth in claim 13, wherein said connector is arranged to provide a first end lock with said through runner web.

15. A suspension ceiling grid system as set forth in claim 14, wherein said first end lock provided by said connector is releasable without tools by the manipulation of said through runner and associated runner performed to release the connector-to-connector lock.

16. A suspension ceiling grid system as set forth in claim 12, wherein the slot is narrow at opposite vertical ends and is widened at a mid-section between said ends.

17. A connector on an elongated suspended ceiling grid runner having a longitudinal axis, the connector being adapted to mate with an identical opposed connector through a hole in a through runner web and comprising a generally planar metal body, the body having a forward portion and an intermediate portion, the forward portion being arranged to laterally abut the intermediate portion of an opposed connector, the forward portion and intermediate portion of opposed identical units of said connector having interlocking elements including laterally extending edges that produce a connector-to-connector lock, the interlocking elements having a configuration when either a tensile force or a compressive force is applied to the connection of identical units of said connectors to positively resist lateral separation between abutting sets of said forward and intermediate portions.

18. A connector as set forth in claim 17, wherein the body has an embossed reinforcing rib extending in a longitudinal direction along said intermediate portion and adapted to extend through the slot of the through runner.

* * * * *

UNITED STATES PATENT AND TRADEMARK OFFICE

CERTIFICATE OF CORRECTION

PATENT NO. : 5,517,796
DATED : May 21, 1996
INVENTOR(S) : Gerald L. Koski, et. al.

It is certified that error appears in the above-identified patent and that said Letters Patent is hereby corrected as shown below:

The drawing sheet, consisting of Figs. 2, 3, 4 and 5 should be deleted to be replaced with the drawing sheet, consisting of Figs. 2, 3, 4 and 5 as shown on the attached page.

Delete drawing sheet 3 of 6. Add drawing sheet, consisting of Figs. 2A, 2B, 2C, 2D and Fig 6 as shown on the attached page.

Signed and Sealed this

Fifth Day of November, 1996

*Attest:*

Bruce Lehman

BRUCE LEHMAN

*Attesting Officer*

*Commissioner of Patents and Trademarks*